US006087917A

United States Patent [19]

Roessler et al.

[11] Patent Number: 6,087,917

[45] **Date of Patent: *Jul. 11, 2000**

[54] POWER MAGNETIC DEVICE AND METHOD OF MANUFACTURE THEREFOR

[75] Inventors: Robert Joseph Roessler; John Albert Sparkes, Jr., both of Rowlett; William Lonzo Woods, Jr., Kaufman, all of Tex.

[73] Assignee: Lucent Technologies Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/678,917

[22] Filed: Jul. 12, 1996

[51] Int. Cl.[7] ..... H01F 27/02; H01F 27/30; H01F 41/02

[52] U.S. Cl. ..... 336/96; 29/606; 29/607; 336/100; 336/205

[58] Field of Search ..... 336/96, 205; 29/100, 29/605, 606, 602.1, 607, 608, 609

[56] References Cited

U.S. PATENT DOCUMENTS

| | | | |
|---|---|---|---|
| 2,743,308 | 4/1956 | Bardsley | 336/96 |
| 3,054,962 | 9/1962 | Opitz | 336/96 |
| 3,183,463 | 5/1965 | Wright | 336/100 |
| 3,210,701 | 10/1965 | Fastner et al. | 336/96 |
| 3,530,417 | 9/1970 | Link | 336/96 |
| 3,721,747 | 3/1973 | Renskers | 336/96 |
| 3,742,411 | 6/1973 | Hill | 336/205 |
| 4,019,167 | 4/1977 | Baker | 336/96 |
| 4,532,398 | 7/1985 | Henriksson | 336/96 |
| 4,847,557 | 7/1989 | Saito et al. | 336/96 |

*Primary Examiner*—Thomas J. Kozma

[57] ABSTRACT

A package for an electronic device, the electronic device including a body having a cavity therein, the body subject to stress from imposition of forces. The package includes a conforming compressible material disposed within at least a portion of the cavity in the body and substantially conforming to an interior configuration of the cavity, reducing imposition of the forces within the cavity and thereby reducing the stress on the body.

18 Claims, 3 Drawing Sheets

POWER MAGNETIC DEVICE AND METHOD OF MANUFACTURE THEREFOR

TECHNICAL FIELD OF THE INVENTION

The present invention is directed, in general, to electronics packaging and, more specifically, to a package for an electronic device that substantially reduces effects due to stress from an imposition of forces on the electronic device and a method of manufacture therefor.

BACKGROUND OF THE INVENTION

It is highly desirable to provide a protective, heat dissipating package for electronic circuitry. Often, such circuitry can be potted, encapsulated or "molded," wherein an encapsulant is formed about the circuitry to yield a unitary, board-mountable package. One well known configuration for board-mountable package is a so-called dual in-line package ("DIP"), wherein electrical leads protrude from opposing sidewalls of the package. The leads are advantageously arranged to allow the package to be mounted to a circuit board by various conventional soldering processes. DIPs are widely used for packaging integrated circuits, most often in computer-related environments.

It has been long felt that power supplies, for instance, would greatly benefit from such encapsulation. However, in the pursuit of producing encapsulated, board-mounted power supply packages, it was discovered that the operation of potting or encapsulating the power supply circuitry with a room temperature vulcanizing ("RTV") silicone compound, or a conventional thermosetting epoxy molding compound through a conventional transfer molding process, seriously degraded the magnetic performance and efficiency of the magnetic devices within the power supply circuitry. As a result, the overall efficiency of the power supply plummeted below acceptable levels.

Within the core of the magnetic devices of the power supply are voids or cavities where the RTV silicone compound or epoxy molding compound infiltrates during the potting process. The compounds that permeate the cavities may cause damage to the core of the power supply circuitry when the encapsulant cures. More specifically, the compound expands and induces stresses on the core surrounding the cavity. The stress may induce magnetostriction on the magnetic material of the core thereby degrading the overall performance of the power supply. Moreover, the stress may cause the core to split rendering the heart of the power supply circuitry completely ineffective.

In the past, work-around "solutions" emerged to address this impasse. First, most conventional power supplies simply avoided the problem by remaining unpotted or unencapsulated. Unfortunately, the power supply circuits were unable to take advantage of the physical protection and additional heat-dissipation capacity that potting or encapsulation would have provided. Such unencapsulated power supplies were also difficult to mount on a circuit board due to a lack of suitable solder processes and handling surfaces.

Second, in the few conventional power supplies that were potted or encapsulated, the magnetic devices were required to be grossly overrated by design. After encapsulation, the magnetic performance of the devices degraded as anticipated, but, by sole virtue of their initial gross overrating, remained above an acceptable level. The process of encapsulation, therefore, caused a waste of material and space and produced additional inefficiencies in the power supplies. Further, the encapsulation process utterly failed to address the fundamental degradation problem.

Another related problem, with conventional encapsulated power supplies, a tendency for the magnetic devices of the power supplies to fail dramatically increased. After encapsulation, expansion of compounds in the cavities of the magnetic devices produce splits and cracks in the core of the power supplies leading to a very poor yield of acceptable devices.

Early attempts to solve the problems surrounding the encapsulation of the power supplies included-processes where the RTV compound or epoxy compound were excluded from the cavity of the core. These steps in the potting or molding process had limited successes and were often unreliable. Basically, mechanical devices, including foams of various shapes and sizes or nomex paper, were placed in the cavity of the core to exclude the compound from invading the cavity. Alternatively, epoxies with a low coefficient of thermal expansion ("CTE") were employed to dam or block the RTV compound or molding epoxy compounds from getting into the cavity.

While the aforementioned measures achieved minimal levels of success, degradation of performance due to effects of magnetostriction and splitting of the cores caused by the hydraulic forces induced by the expansion of the RTV or molding compounds in the cavities remain unacceptable. Furthermore, the mechanical devices were unable to completely match the void permitting the RTV or molding compound to fill the cavities.

Accordingly, what is first needed in the art is an understanding of the underlying effect that occurs when electronic devices are subject to forces, causing the performance of the devices to degrade and the production yield to be unacceptable. Further, what is needed (once the effects are understood) is an package for an electronic device and an associated highly economical and feasible method of manufacture for such packages that preserve the integrity and electrical performance by directly addressing the effect.

SUMMARY OF THE INVENTION

To address the above-discussed deficiencies, the present invention provides a package for an electronic device, the electronic device including a body having a cavity therein, the body subject to stress from imposition of forces. The package includes a conforming compressible material disposed within at least a portion of the cavity in the body and substantially conforming to an interior configuration of the cavity, reducing imposition of the forces within the cavity and thereby reducing the stress on the body.

The underlying effect that occurs when electronic devices are subject to stresses is breaking or separation of the body and poor performance of the electrical device. The effect may include micro cracks in the body that lead to the eventual deterioration of the electrical device over time and temperature cycling that may not be readily apparent. The use of the conforming compressible material addresses the problem by substantially preventing matter from entering the cavity thereby reducing the forces on the body of the electrical device to retain the integrity of the electrical device.

In one alternative embodiment of the present invention, the package includes an encapsulant capable of generating hydraulic forces on the body, the encapsulant surrounding at least a portion of the body and occluding the cavity. The conforming compressible material substantially prevents the encapsulant from entering the cavity, reducing imposition of the hydraulic forces within the cavity and thereby reducing the stress on the body caused by the encapsulant.

The use of the conforming compressible material, in the present embodiment, substantially prevents the encapsulant from entering the cavity thereby reducing the hydraulic forces on the body of the electrical device. By substantially eliminating the encapsulant from the cavity, the problems associated with the expansion of the encapsulant within the cavity are reduced thereby retaining the integrity of the electrical device. For the purposes of the present invention, the term "occlude" is defined in its broadest sense to include, without limitation, "to cover at least a portion."

In one alternative embodiment of the present invention, the conforming compressible material is a thixotropic syntactic foam. A thixotropic syntactic foam is, generally, encapsulated compressible air bubbles that conform under pressure and solidify under steady state conditions. The thixotropic syntactic foam, therefore, conforms to the cavity during the molding process and solidifies within the cavity during the curing process. One skilled in the pertinent art should understand that other conforming compressible materials are well within the broad scope of the present invention.

In one alternative embodiment of the present invention, the electronic device is a power magnetic device and the body is a magnetic core subject to magnetostriction from imposition of the forces, the cavity located between oppositely-facing halves of the magnetic core. In a related but alternative embodiment of the present invention, the package further includes a plurality of windings disposed between the halves of the magnetic core and through the cavity, the power magnetic device being a transformer.

An underlying effect that occurs when power magnetic devices are subject to forces (causing the magnetic performance of the devices to degrade), is magnetostriction. Magnetostriction has been found to be brought about by pressures and stresses (e.g., molding pressures and post-molding stresses) on the magnetic cores within the power supply circuitry. Magnetostriction in cores (e.g., ferrite cores) causes degradation of magnetic properties when they are placed under tensile or compressive stress. Magnetostriction causes the permeability of the ferrite core to decrease and coercivity of the ferrite core to increase. As a result, the electrical design of the power module circuit suffers from both reduced inductance values and reduced quality factors (e.g., higher core losses). The conforming compressible material, constructed according to the principles of the present invention, substantially prevents matter (e.g., an encapsulant) from entering the cavity thereby reducing imposition of the forces within the cavity and thereby reducing the stress and, ultimately, the effects of magnetostriction on the magnetic core.

In one alternative embodiment of the present invention, the encapsulant is room temperature vulcanizing (RTV) silicone compound. One skilled in the pertinent art should understand that other encapsulating materials such as, without limitation, a thermosetting epoxy molding compound are well within the broad scope of the present invention.

In one alternative embodiment of the present invention, the cavity has a width of about 0.01 inches. The conforming compressible material, constructed in accordance with the principles of the present invention, conforms to any size and shape of cavity within the body of the electrical device. For instance, the cavity may constitute a rectangular window having a width of about 0.01 inches and a volume of 0.0022 cubic inches; the cavity may also occupy, without limitation, an equivalent spherical volume within the body of the electrical device. One skilled in the pertinent art should understand that any cavity dimension is well within the broad scope of the present invention.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

DETAILED DESCRIPTION

Figure 1:
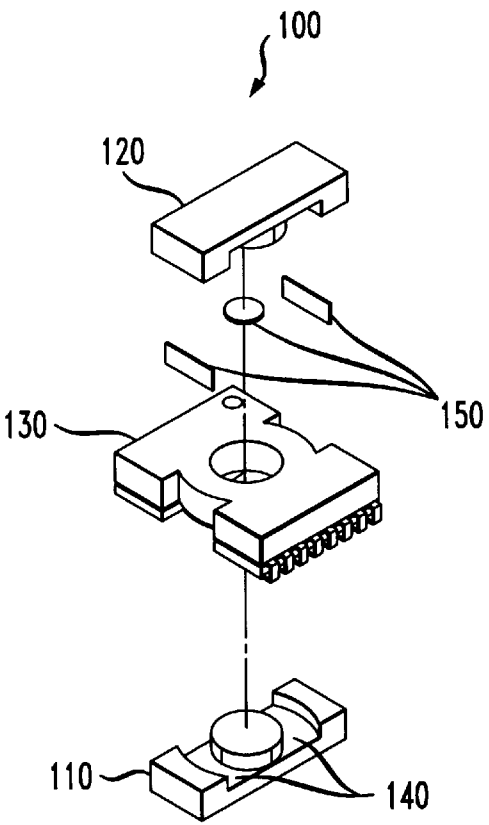
FIG. 1 PRIOR ART
FIG. 1 illustrates an exploded isometric view of a magnetic device constructed in accordance with the prior art.

Turning now to FIG. 1, illustrated is an exploded isometric view of a magnetic device 100 constructed in accordance with the prior art. The magnetic device 100 employs mechanical spacers 150 to exclude an encapsulant (not shown), dispersed over the magnetic device 100 during a molding process, from permeating cavities 140 in the magnetic device 100. The magnetic device 100 includes a first oppositely-facing core half ("first core half") 110 and a second oppositely-facing core half ("second core half") 120. The magnetic device 100 also includes a plurality of windings (not shown) encapsulated in a molded package with a plurality of protruding leads (hereinafter referred to as a molded coil and collectively designated 130).

The prior art process of constructing the magnetic device 100 into a packaged molded device generally included the following steps. First, an epoxy compound (not shown) was placed on the first core half 110 to dam the encapsulant from entering the cavities 140 between the first and second core halves 110, 120 and the molded coil 130. Second, the molded coil 130 was placed on the first core half 110. Third, the spacers (e.g., nomex paper) 150 were inserted between the molded coil 130 and the cavities 140, including a center post of the core halves. Fourth, the second core half 120 was glued (not shown) to the first core half 110. Finally, the constructed magnetic device 100, which could be mounted on or integrated with a printed wiring board (PWB), was overmolded with the encapsulant and the encapsulated magnetic device was set for curing.

The previous devices for and methods of encapsulating magnetic devices did not adequately protect the core from hydraulic forces from the encapsulant. As previously mentioned, when the encapsulant permeates the cavities the resulting stress provokes several problems. The problems include poor manufacturing yield due to core breaking or separation and poor performance due to the effects of magnetostriction. Also, the core may have micro cracks that lead to breaking over time and temperature cycling that may not be readily apparent. The prior art mechanical measures and chemical processes to address this situation were simply inadequate.

Figure 2:
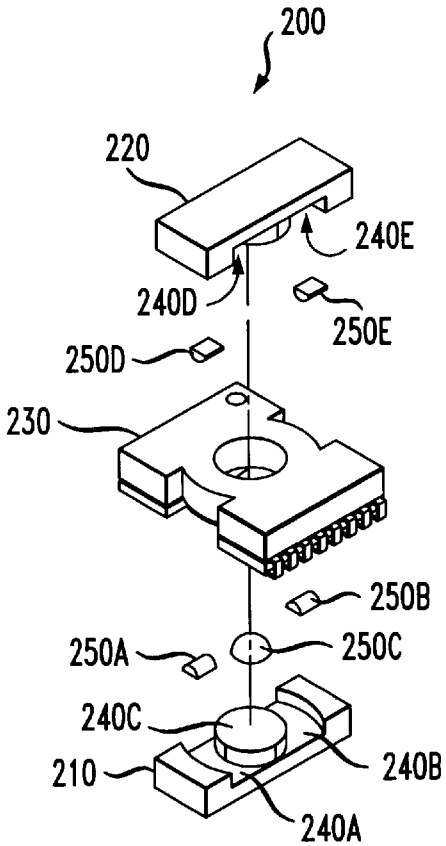
FIG. 2 illustrates an exploded isometric view of a magnetic device employing a conforming compressible material in accordance with the present invention.

Turning now to FIG. 2, illustrated is an exploded isometric view of a magnetic device 200 employing a conforming compressible material 250A, 250B, 250C, 250D, 250E in accordance with the present invention. Analogous to the magnetic device 100 presented in FIG. 1, the magnetic device 200 includes a magnetic core (e.g., a ferrite core) consisting of a first oppositely-facing core half ("first core half") 210 and a second oppositely-facing core half ("second core half") 220. The magnetic device 200 also includes a plurality of windings (not shown) encapsulated in a molded package with a plurality of protruding leads (hereinafter referred to as a molded coil and collectively designated 230). In contrast to the magnetic device 100 of FIG. 1, the magnetic device 200 does not employ mechanical spacers or other prior art means to exclude an encapsulant (see FIG. 3), dispersed over the magnetic device 200 during a molding process, from permeating cavities 240A, 240B, 240C, 240D, 240E in the magnetic device 200.

An exemplary process of constructing the magnetic device 200 into a packaged molded device in accordance with the present invention generally includes the following steps. First, the conforming compressible material (e.g., a thixotropic syntactic foam such as a Wacker Silicones SLM77133 manufactured by the Wacker Silicones Corporation of Adrian, Mich.) 250A, 250B, 250C is disposed within at least a portion of the cavities 240A, 240B, 240C in the first core half 210, including the legs and center post, if gapped (see FIG. 3). Second, the molded coil 230 is placed on the first core half 210. Third, the conforming compressible material 250D, 250E is disposed within at least a portion of the cavities 240D, 240E in the second core half 220. Fourth, the second core half 220 is interfacially glued (employing beads of glue; not shown) to the first core half 210. Finally, the constructed magnetic device 200 is overmolded with the encapsulant and the encapsulated magnetic device is set for curing. One skilled in the pertinent art should understand that the aforementioned process is presented for illustrative purposes only. Additionally, the process of potting electronic devices with an encapsulant, including the curing and cleaning processes associated therewith, should be understood by one skilled in the pertinent art.

The conforming compressible material 250A, 250B, 250C, 250D, 250E (collectively designated 250) accommodates a wide variety of cavity dimensions and is no longer restricted by the mechanical sizes of nomex papers, epoxy adhesives or cured foams employed in the past to fill small and large cavities to exclude the encapsulant. The use of the conforming compressible material 250 will permeate the cavities 240A, 240B, 240C, 240D, 240E (collectively designated 240) within the magnetic device 200 regardless of the size (e.g., a rectangular window having a width of about 0.01 inches and a volume of 0.0022 cubic inches) and provide stress relief from hydraulic forces induced by the encapsulant. The conforming compressible material 250 provides the stress relief in the cavity 240 and results in an application of the gas laws instead of hydraulic forces resulting from the coefficient of thermal expansion ("CTE") relating to the encapsulant. The cavity 240 is, therefore, protected by the conforming compressible material 250 thereby substantially excluding the encapsulant, but, at the same time, allowing the encapsulant to creep into this area as the encapsulant thermally expands without substantially affecting the magnetic device 200.

Figure 3:
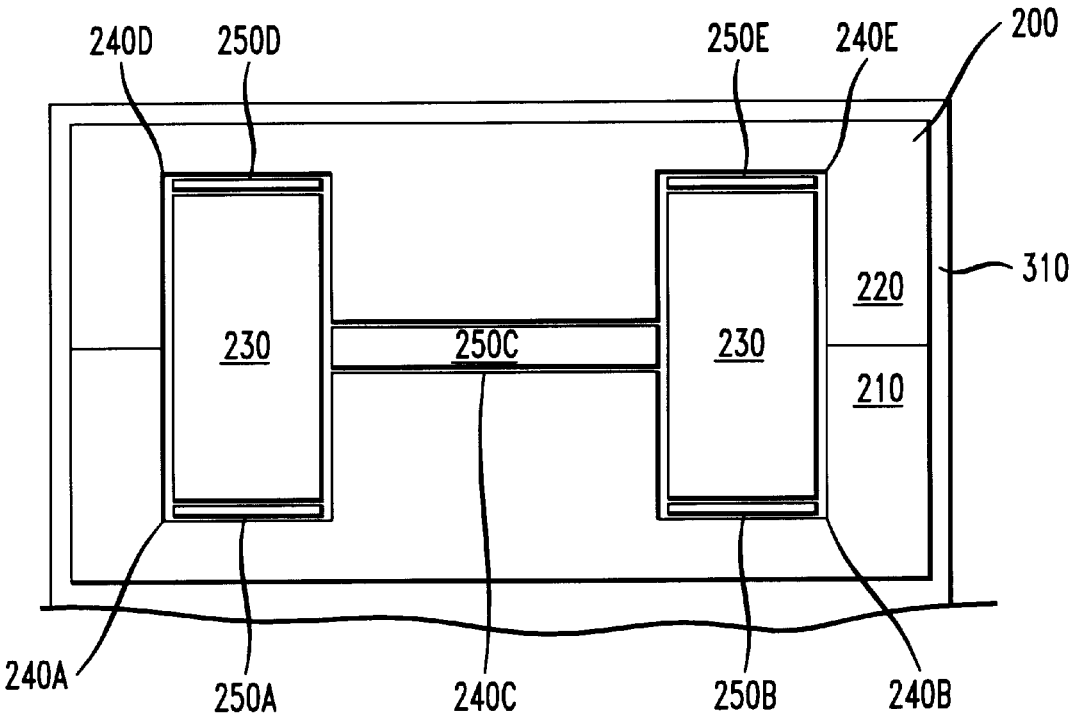
FIG. 3 illustrates a cross-sectional view of the magnetic device of FIG. 2.

Turning now to FIG. 3, illustrated is a cross-sectional view of the magnetic device 200 of FIG. 2. The first and second core halves 210, 220 are illustrated about the molded coil 230 to form the constructed magnetic device 200. The conforming compressible material 250A, 250B, 250C, 250D, 250E is disposed within at least a portion of the cavities 240A, 240B, 240C, 240D, 240E, respectively, formed in the magnetic device 200. An encapsulant 310 is dispersed about the magnetic device 200 to form an encapsulated magnetic device 200. As previously mentioned, the conforming compressible material (collectively designated 250) substantially prevents the encapsulant 310 from entering the cavities (collectively designated 240) thereby reducing the hydraulic forces on the core of the magnetic device 200. By substantially eliminating the encapsulant 310 from the cavities 240, the problems associated with the expansion of the encapsulant 310 within the cavities 240 are reduced thereby retaining the integrity of the magnetic device 200.

Figure 4:
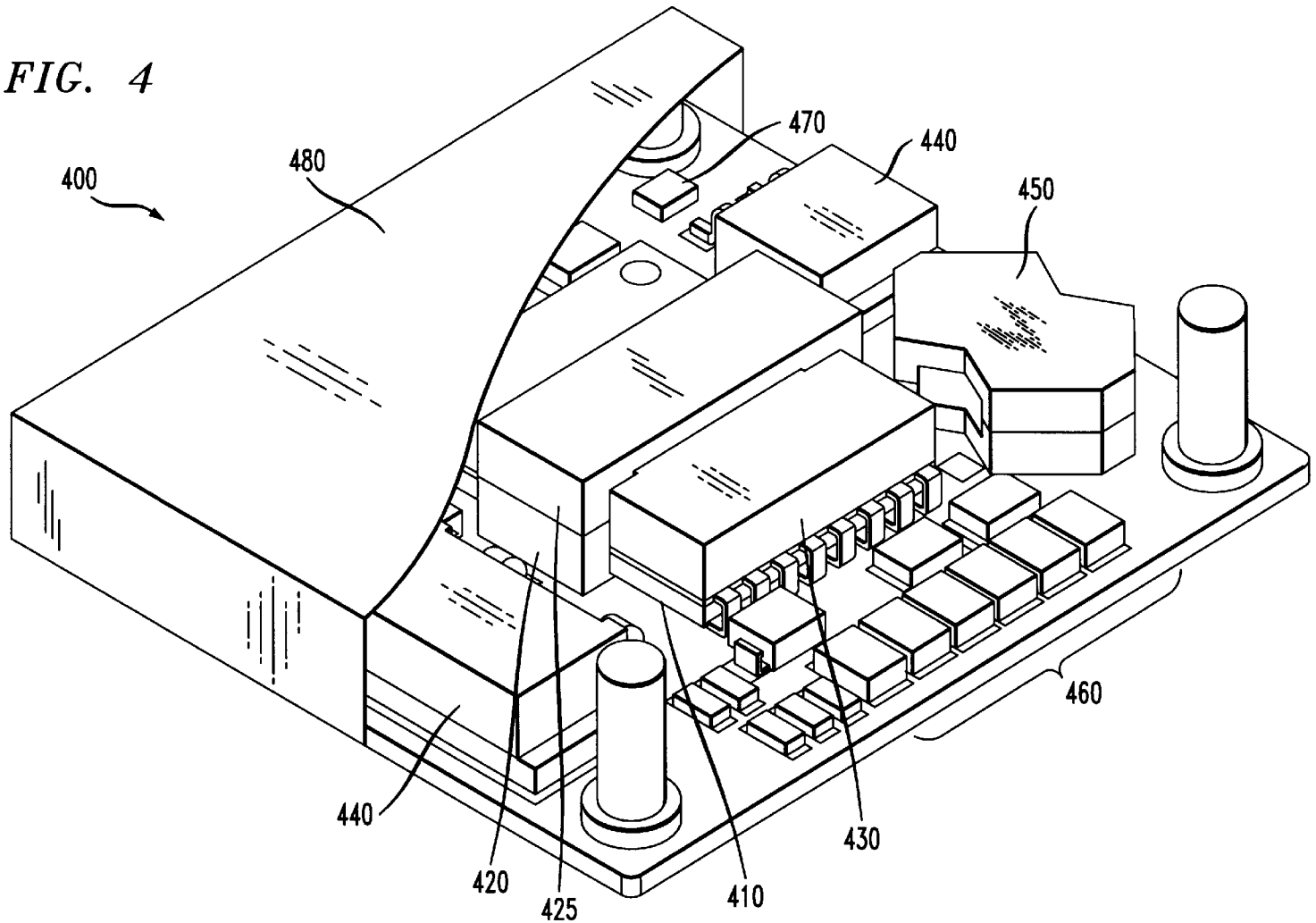
FIG. 4 illustrates an encapsulated power supply module including a magnetic device employing a conforming compressible material constructed in accordance with the present invention.

Turning now to FIG. 4, illustrated is an encapsulated power supply module (e.g., a DC/DC converter) 400 including a magnetic device 410 employing a conforming compressible material constructed in accordance with the present invention. The magnetic device 410 (e.g., a transformer) includes a magnetic core with core halves (a first and second core half 420, 425) having a cavity therebetween (not shown). The magnetic device 410 also includes a plurality of windings (not shown) encapsulated in a molded package with a plurality of protruding leads (hereinafter referred to as a molded coil and collectively designated 430). The magnetic core is subject to hydraulic forces and magnetostriction when placed under stress. The power supply module 400 also includes power supply circuitry, coupled to the magnetic device 410, for converting electrical power.

In the illustrated embodiment, the power supply circuitry includes, in part, switching circuitry (e.g., field effect transistors) 440, an inductor 450, a plurality of resistors 460 and a capacitor 470. The power supply module 400 converts an input voltage to a regulated output voltage for delivery to a load (not shown) coupled thereto. While the power supply module 400 of the present embodiment is a DC/DC converter, one skilled in the pertinent art should understand that other power supply topologies are well within the broad scope of the present invention. The power supply module 400 is encapsulated by an encapsulant (e.g., a room temperature vulcanizing ("RTV") silicone compound) 480 during a potting or molding process to produce the encapsulated power supply module 400.

As previously mentioned, the conforming compressible material is disposed within at least a portion of a cavity (see FIG. 2) of the magnetic core of the magnetic device 410. The conforming compressible material conforms to an interior configuration of the cavity to substantially exclude the encapsulant 480 from the cavity. The conforming compressible material thereby reduces the hydraulic forces and magnetostriction upon the magnetic core caused by stress from the encapsulant on the first and second core halves 420, 425 of the magnetic core.

One skilled in the pertinent art should understand that while the present invention is disclosed in connection with a magnetic device in an encapsulated power supply module, the principles of the present invention are equally applicable to any electronic device subject to forces causing stress on the body of the device. Additionally, while the encapsulant 480 is illustrated with respect to the power supply module, the same principles apply to the molding of individual components to form an encapsulated package for an electronic device.

Although the present invention has been described in detail, those skilled in the art should understand that they can make various changes, substitutions and alterations herein without departing from the spirit and scope of the invention in its broadest form.

What is claimed is:

1. A power magnetic device, comprising:

a magnetic core with core halves having a cavity therebetween, said magnetic core subject to stress from imposition of forces caused by thermal expansion of encapsulant within said cavity; and a plurality of discrete conforming compressible thixotropic bodies disposed within a portion of said cavity and substantially conforming to an interior configuration of said cavity without permeating said cavity, said conforming compressible thixotropic bodies adapted to substantially exclude said encapsulant from said portion of said cavity and to compress when said encapsulant thermally expands into said portion of said cavity thereby reducing stress on said magnetic core from imposition of said forces.

2. The power magnetic device as recited in claim 1 wherein said conforming compressible thixotropic material is a conforming compressible thixotropic syntactic foam.

3. The power magnetic device as recited in claim 1 wherein said magnetic core is subject to imposition of hydraulic forces caused by thermal expansion of said encapsulant within said cavity.

4. The power magnetic device as recited in claim 1 wherein said magnetic core is subject to magnetostriction from imposition of said forces.

5. The power magnetic device as recited in claim 1 further comprising a plurality of windings disposed between said halves of said magnetic core and through said cavity, said power magnetic device being a transformer.

6. The power magnetic device as recited in claim 1 wherein said cavity has a width of about 0.01 inches.

7. A method of manufacturing a power magnetic device, comprising:

creating a cavity between core halves of a magnetic core, said magnetic core subject to stress from imposition of forces caused by thermal expansion of encapsulant within said cavity; and disposing a plurality of discrete conforming compressible thixotropic bodies within a portion of said cavity and substantially conforming to an interior configuration of said cavity without permeating said cavity, said conforming compressible thixotropic bodies adapted to substantially exclude said encapsulant from said portion of said cavity and to compress when said encapsulant thermally expands into said portion of said cavity thereby reducing stress on said magnetic core from imposition of said forces.

8. The method as recited in claim 7 wherein said conforming compressible thixotropic material is a conforming compressible thixotropic syntactic foam.

9. The method as recited in claim 7 wherein said magnetic core is subject to imposition of hydraulic forces caused by thermal expansion of said encapsulant within said cavity.

10. The method as recited in claim 7 wherein said magnetic core is subject to magnetostriction from imposition of said forces.

11. The method as recited in claim 7 further comprising disposing a plurality of windings between said halves of said magnetic core and through said cavity, said power magnetic device being a transformer.

12. The method as recited in claim 7 wherein said cavity has a width of about 0.01 inches.

13. A power supply module, comprising:

power supply circuitry for converting electrical power;

a power magnetic device having magnetic core halves with a cavity therebetween, said magnetic core subject to stress from imposition of forces caused by thermal expansion of encapsulant within said cavity;

a plurality of discrete conforming compressible thixotropic bodies disposed within a portion of said cavity and substantially conforming to an interior configuration of said cavity without permeating said cavity; and an encapsulant substantially surrounding said magnetic core and occluding said cavity, said conforming compressible thixotropic bodies adapted to substantially exclude said encapsulant from said portion of said cavity and to compress when said encapsulant thermally expands into said portion of said cavity thereby reducing stress on said magnetic core from imposition of said forces.

14. The power supply module as recited in claim 13 wherein said conforming compressible thixotropic material is a conforming compressible thixotropic syntactic foam.

15. The power supply module as recited in claim 13 wherein said magnetic core is subject to imposition of hydraulic forces caused by thermal expansion of said encapsulant within said cavity.

16. The power supply module as recited in claim 13 wherein said magnetic core is subject to magnetostriction from imposition of said forces.

17. The power supply module as recited in claim 13 further comprising a plurality of windings disposed between said halves of said magnetic core and through said cavity, said power magnetic device being a transformer.

18. The power supply module as recited in claim 13 wherein said cavity has a width of about 0.01 inches.

* * * * *